US006295897B1

(12) United States Patent
Swank et al.

(10) Patent No.: US 6,295,897 B1
(45) Date of Patent: Oct. 2, 2001

(54) MULTI-SOCKET SKATEBOARD TOOL

(75) Inventors: Tod Swank; Matthew J. Barker; Joshua Z. Beagle, all of San Diego, CA (US)

(73) Assignee: Tum Yeto, Inc., San Diego, CA (US)

( * ) Notice: Subject to any disclaimer, the term of this patent is extended or adjusted under 35 U.S.C. 154(b) by 0 days.

(21) Appl. No.: 09/454,662

(22) Filed: Dec. 3, 1999

(51) Int. Cl.[7] ..... B25B 13/06

(52) U.S. Cl. ..... 81/124.4; 81/125.1; 7/151; 7/138

(58) Field of Search ..... 81/124.4, 124.3, 81/124.7, 437, 439, 125.1, 3.09, 3.55, 3.57; D8/26–29; 7/151, 138

(56) References Cited

U.S. PATENT DOCUMENTS

| | | | | |
|---|---|---|---|---|
| D. 224,677 | * | 8/1972 | Lehnhard . | |
| D. 241,114 | * | 8/1976 | Hess . | |
| D. 243,506 | | 3/1977 | Hess | D8/87 |
| D. 278,510 | * | 4/1985 | Schoeberlein | D8/28 |
| D. 308,327 | * | 6/1990 | Klippel | D8/29 |
| 3,872,527 | | 3/1975 | Tregoing . | |
| 4,089,077 | * | 5/1978 | Morton | 7/138 |
| 4,560,344 | * | 12/1985 | Kietaibl | 7/151 |
| 4,569,653 | * | 2/1986 | Becker et al. | 7/151 |
| 4,774,736 | | 10/1988 | Brawner et al. | 7/138 |
| 4,856,387 | * | 8/1989 | Gibson | 81/124.4 |
| 5,186,083 | | 2/1993 | Hsiao | 81/124.4 |
| 5,557,992 | * | 9/1996 | Macor | 81/124.4 |

FOREIGN PATENT DOCUMENTS

| | | |
|---|---|---|
| 323082 | 8/1957 | (CH) . |
| 2125289 | 11/1972 | (DE) . |
| WO99/61207 | 12/1999 | (WO) . |

* cited by examiner

*Primary Examiner*—D. S. Meislin
(74) *Attorney, Agent, or Firm*—Pillsbury Winthrop LLP

(57) ABSTRACT

A hand tool comprising at least three variously-sized sockets for use with nuts and bolts on skateboards is described. The multi-socket hand tool comprises a rod having a first rod end and a second rod end; a first socket head mounted to the first rod end, the first socket head defining a first socket, wherein the angle between the longitudinal axis of the first socket and the longitudinal axis of the rod is between about 95° and about 135°; and second and third socket heads mounted to the second rod end, the second and third socket heads defining second and third sockets, respectively. The hand tool may, optionally, further include means for removing a bottle cap so that the tool can additionally function as a bottle opener.

22 Claims, 6 Drawing Sheets

MULTI-SOCKET SKATEBOARD TOOL

FIELD OF THE INVENTION

The present invention relates generally to a hand tool that is useful in the adjusting, repairing and/or replacing of parts on skateboards. More specifically, the present invention relates to a skateboard tool having at least three variously-sized sockets and, optionally, a bottle opener.

BACKGROUND OF THE INVENTION

Skateboards are well known and currently used by individuals for purposes of exercise, recreation and competition. Various skateboard designs are known in the art. Traditional skateboards typically comprise a longitudinally elongated, roughly planar platform having on the bottom surface two straight axles positioned transversely across each end of the platform. The axles are mounted to the bottom surface of the platform by a truck. Wheels pivotally mounted on the ends of the axles provide a motive base.

There are a variety of commercially available wheels, boards and trucks. In addition to there being a number of truck manufacturers, there are a number of different types and designs of trucks that are used for different skateboarding conditions. For example, there may be a truck type that is particularly adapted to a certain riding mode (e.g., stairs, railings, bowls, spines or pipes) that is unsuitable for other courses or riding modes. This is due in part to the tightness or softness of the truck pivoting assembly, the size of the truck, and the type of wheels. Trucks also generally have a tightness adjustment so that the same truck can be tightened up to require more turning force. Thus, the same trucks can be used to cover a range of skateboarding conditions.

However, despite the fact that trucks are generally adjustable, a competition rider may have several truck sets that he/she will switch on and off of the board during the course of the various events in a typical skateboarding competition. Additionally, the rider typically needs to periodically adjust the tension on the truck, and tighten any nuts or bolts that may loosen during use. Also, in order to keep their boards in good working order, skateboarders must periodically replace worn out parts, such as wheels and wheel bearings, so that their skateboards may continue to function properly.

Nuts and bolts of various sizes are used for adjusting the truck, securing the truck to the board and for securing the wheels onto the ends of the axles. These nuts and bolts often have limited accessibility (i.e., are in tight spaces) and, thus, can be very difficult and cumbersome to loosen or remove using traditional pliers or wrenches. Even dedicated skateboard tools that are currently available are not ideal in this respect. In particular, the nut or bolt used to secure the truck to the board (typically, ⅜" hexagonal socket size) is usually difficult to directly access because of a proximal lip or overhang found on many popular truck designs.

For definitional purposes, a nut or bolt used to secure a truck to a board is referred to herein as a "truck fastener" and a socket used for adjusting a truck fastener is referred to herein as a "truck fastener socket."

Currently available skateboard tools are usually generally T-shaped and consist of three arms. Socket heads having sockets of various sizes are located at the ends the arms. However, each of the sockets is generally aligned with an arm (i.e., the center axis of the socket is co-linear or at least parallel with the longitudinal axis of the arm to which it is attached). As a result, these tools are cumbersome to use in tight spaces or where direct in-line access to the nut or bolt is restricted (i.e., where access is best made from the side, preferably diagonally, instead of in-line, as in a conventional screwdriver). Examples of such tool designs are illustrated in Design U.S. Pat. No. 308,327 and described in U.S. Pat. No. 4,774,736, the disclosures of which are incorporated herein by reference.

In view of the foregoing, there exists a need for a skateboard tool having sockets that facilitate use with the various nuts and bolts found on skateboards, especially where there may be limited access. In particular, there is a need for a skateboard tool having a truck fastener socket (usually, ⅜" socket size) which is oriented to permit access to a truck fastener despite the proximal lip or overhang found on many contemporary truck designs.

SUMMARY OF THE INVENTION

The present invention addresses the foregoing needs by providing a skateboard tool comprising a rod on which are mounted at least three variously-sized sockets. Importantly, the truck fastener socket of the instant tool is not aligned with the rod. Rather, the truck fastener socket is oriented at an appropriate angle, such that the rod extends outward diagonally when the socket is fitted over a truck fastener and is free from significant interference from the above-described lip or overhang. In addition, the skateboard tool optionally includes means for removing a bottle cap (e.g., a cut-away portion useful as a bottle opener).

In a preferred embodiment, the present invention is directed to a multi-socket hand tool for use with a skateboard. The tool includes a rod having a first end and a second end. A first socket head is mounted to the first end, wherein the first socket head defines a first socket. The angle between the longitudinal axis of the first socket and the longitudinal axis of the rod is preferably between about 95° and about 135°. This range of angles permits the first socket head to access the truck fastener without significant interference from the proximal lip or overhang found on many contemporary skateboard truck designs. Second and third socket heads are mounted to the second end of the rod, wherein the second and third socket heads define second and third sockets, respectively.

The skateboard tool preferably has a rod between about 0.5" and about 6" in length for compactness and convenience. The rod is preferably generally linear and, most preferably, is generally cylindrical. Preferably, the longitudinal axes of the rod and the three sockets are approximately co-planar, so that the tool is generally flat.

In a particularly preferred embodiment, the second and third sockets are generally oppositely-directed. For example, the second and third socket heads may be integral (one-piece) so as to resemble a double-headed socket head where, for example, the longitudinal axes of the second socket and the third socket are approximately co-linear.

The first socket is preferably hexagonal and approximately ⅜", so as to be useful as a truck fastener socket. In a preferred embodiment, the first, second and third sockets have different sizes. In one embodiment, the three sockets are hexagonal and the size of the first socket is approximately ⅜" and the sizes of the second and third sockets are, in either order, approximately ½" and approximately 9/16".

The tool preferably comprises a metal or a metal alloy, such as a steel or steel alloy. The tool may be one-piece (i.e., integral), such as where the tool is cast metal or metal alloy. Alternatively, the tool may be made up of two or more parts that are welded or braized, or otherwise bonded, fitted or attached together. For example, in certain embodiments, one or more of the first, second or third socket heads can be mounted to the rod by welding.

In certain embodiments, the skateboard tool may, optionally, further comprise means for removing a bottle cap (i.e., a bottle opener). In one embodiment, the bottle cap removing means defines a diagonal notch in the double-headed socket head, which can be made, for example, by standard machining techniques.

DETAILED DESCRIPTION OF PREFERRED EMBODIMENTS

Figure 1:
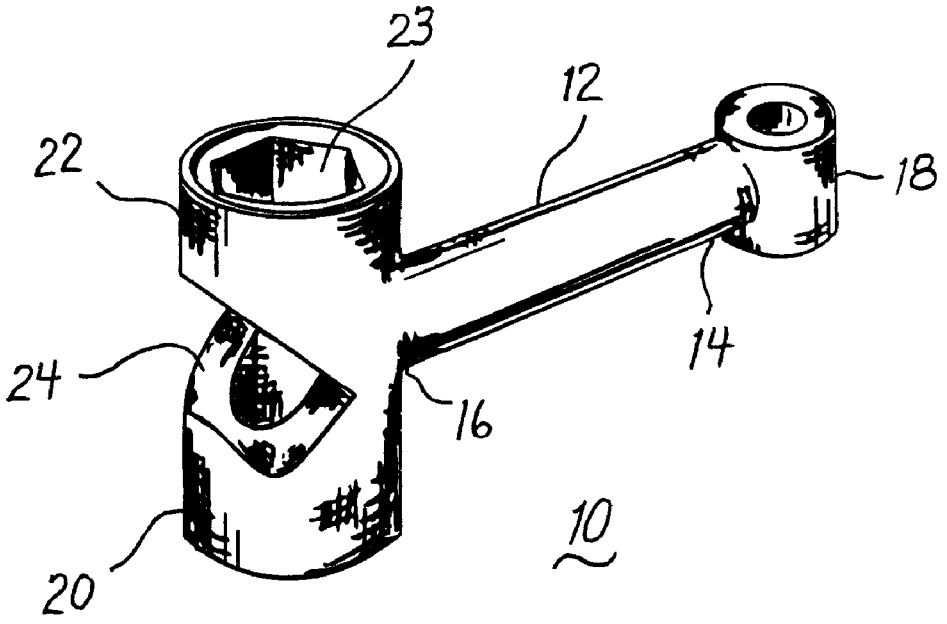
FIG. 1 is a perspective view of a preferred embodiment of the skateboard tool of the present invention, illustrating three variously-sized sockets and an optional cut-away portion (i.e., a diagonal notch) useful as a bottle cap opener.
Figure 2:
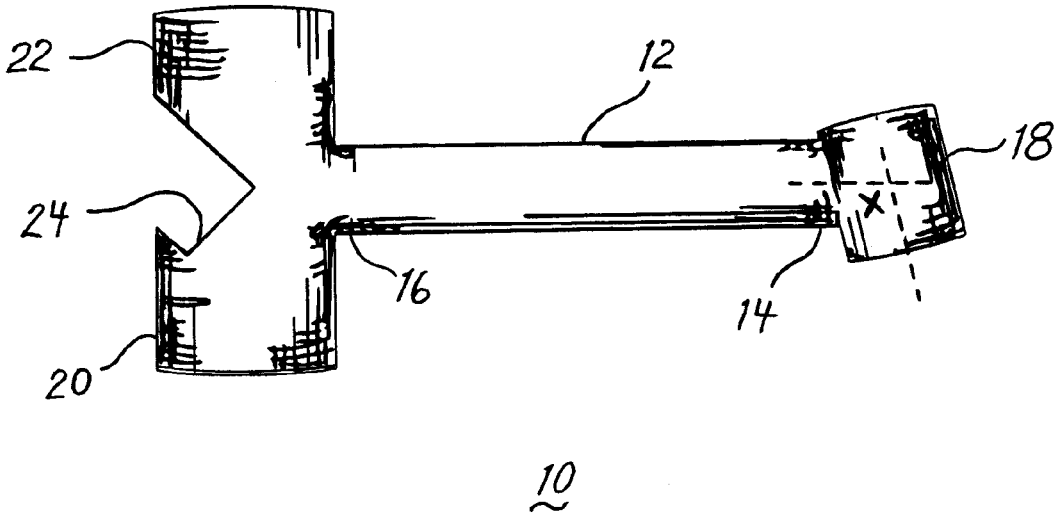
FIG. 2 is a side plan view thereof.
Figure 3:
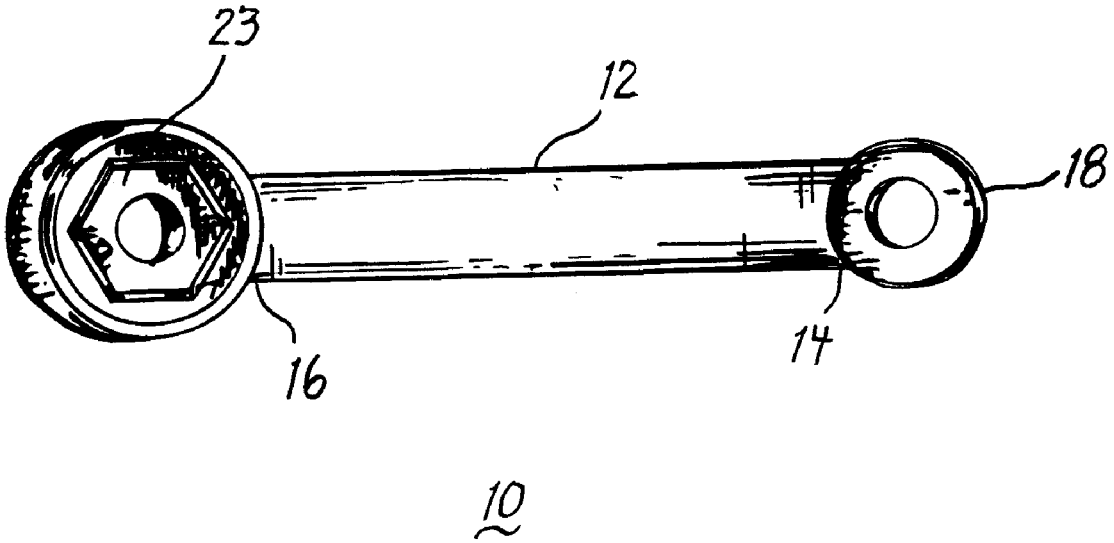
FIG. 3 is a top plan view thereof.
Figure 4:
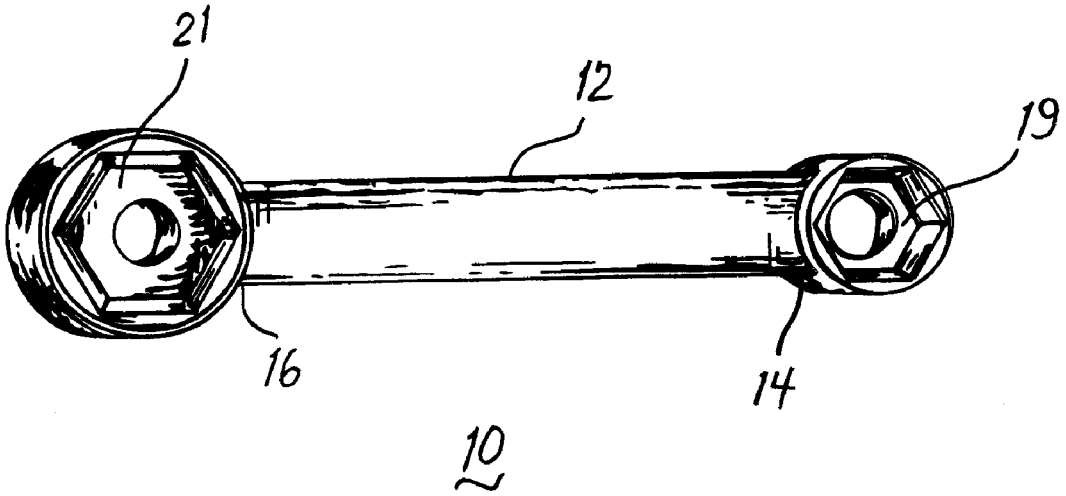
FIG. 4 is a bottom plan view thereof.
Figure 5:
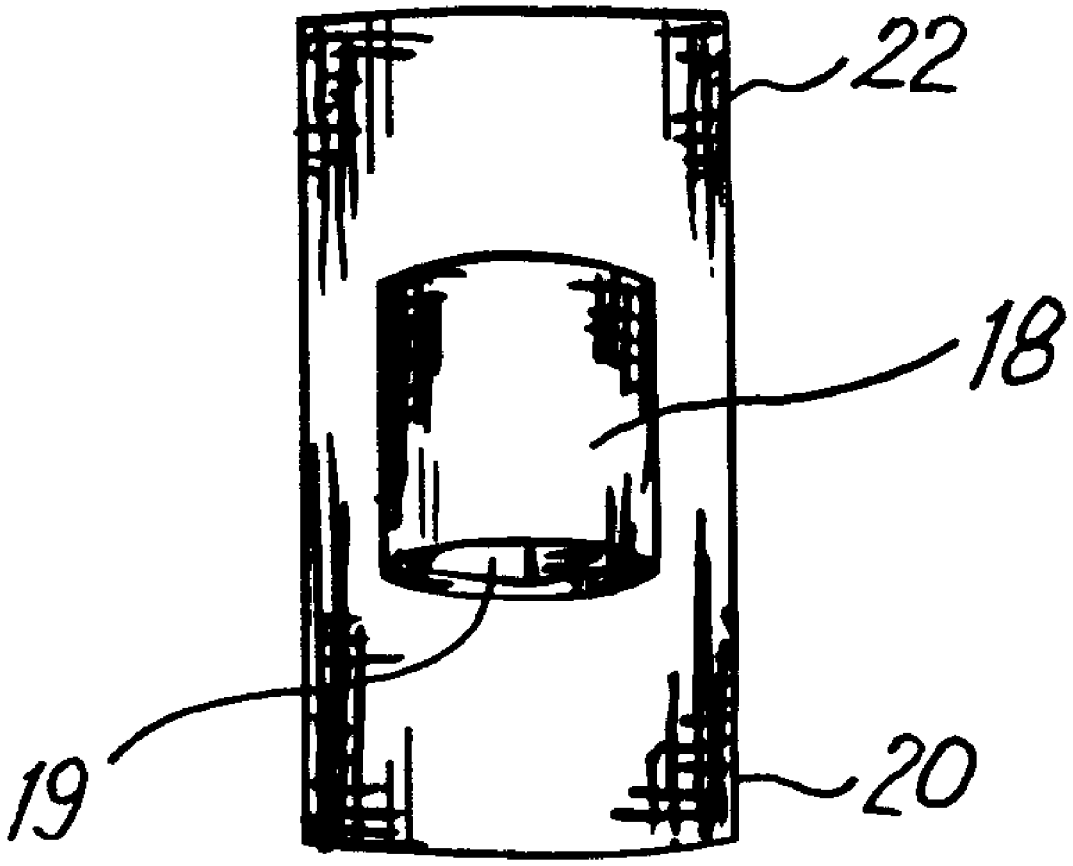
FIGS. 5 and 6 are end views thereof.
Figure 6:
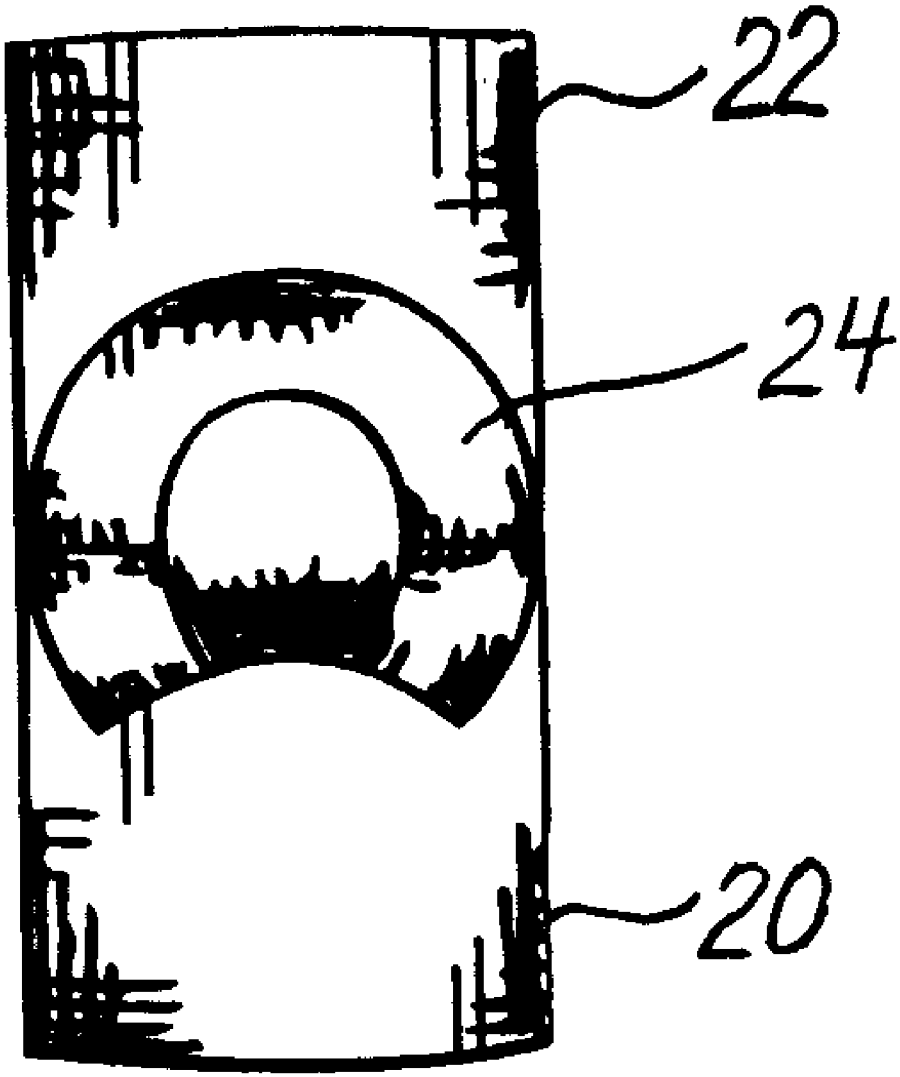

Referring now to the figures (see FIGS. 1–5), a preferred embodiment of the skateboard tool 10 is illustrated. The skateboard tool 10 comprises a rod 12 having a first rod end 14 and a second rod end 16. A first socket head 18 defining a hexagonal socket 19 is mounted (e.g., by welding) directly or indirectly to the first rod end 14. A second socket head 20 and a third socket head 22 are mounted to the second rod end 16. The second socket head 20 and the third socket head 22 define a second hexagonal socket 21 and a third hexagonal socket 23, respectively.

The term "rod" as used herein is intended to refer to any structural member having a longitudinal dimension greater than its transverse dimensions, and includes tapered rods. In addition, the term "rod" includes members having any cross-sectional shape, including, for example, circular (i.e., generally cylindrical rods), oval, triangular and hexagonal, among others. Rods for use in the present invention are preferably generally linear, but may be arcuate in whole or in part.

The angle between the longitudinal axis of the first hexagonal socket 19 and the longitudinal axis of the rod 12 is defined by angle X (see FIG. 2) and is preferably between about 95° and about 135°. This range of angles permits the first socket head 18 to access a truck fastener without significant interference from the proximal lip or overhang found on many contemporary skateboard truck designs. More preferably, the angle is between about 95° and about 110° and, most preferably, is between about 100° and about 105°. The longitudinal axis of the rod 12 is defined at the first rod end 14 (i.e., at the intersection of the rod 12 and the first socket head 20), thereby making it possible to define the angle X regardless of the overall general shape of the rod 12.

Preferably, the second socket head 20 and the third socket head 22 are integral (i.e., one-piece), such as where they are a single cast unit. In the embodiment illustrated in the figures, the second socket head 20 and the third socket head 22 together define or form a double-headed socket head having generally oppositely-directed sockets. In this embodiment, the longitudinal axes of the second socket 21 and the third socket 23 are approximately co-linear (i.e., approximately share a common longitudinal axis).

Either or both of the second socket head 20 and the third socket head 22 can be mounted to the second rod end 16 directly or indirectly. In the case of indirect mounting, the mounting may be way of a rod or other like structural element. Thus, other possible tool configurations include those that are generally star-shaped or Y-shaped, in addition to T-shaped.

While the socket heads illustrated in the figures have generally cylindrical outer contours and have smooth outer surfaces, socket heads useful in the present invention may have any suitable outer shape, including, but not limited to, square, hexagonal, octagonal, rectangular.

The rod 12 is preferably between about 0.5" and about 6" in length, for compactness, light weight and convenience. More preferably, the rod 12 is between 1" and 3" in length. The rod is preferably generally linear and, most preferably, is generally cylindrical (i.e., generally circular cross-section). The rod surface may be smooth, textured, covered or coated with various materials (e.g., rubber or plastic) for improved grip or feel. The rod 12 may comprise any suitably rigid and durable material including, especially, metals, metal matrix composites and metal alloys. In addition, the tool 10 may be any color and may have ornamental designs or logos for branding or other purposes.

Also, it is preferable that each of the sockets are roughly co-planar with the rod 12 and with one another, such that the tool 10 can lie generally flat, as may be ascertained from the preferred embodiment shown in the figures.

The tool 10 and its components can be made from any suitably durable material such as fiberglass, graphite, plastics and polymers. Preferably, the tool 10 comprises a metal, metal matrix composite or a metal alloy, such as a steel or steel alloy (e.g., chrome vanadium). Particularly preferred metals include stainless steels. The tool 10 may be one-piece (i.e., integral), such as where the tool is cast metal or metal alloy. Alternatively, the tool 10 may be made up of two or more parts that are welded or otherwise bonded, fitted or attached together. It is preferred that the rod and sockets are separately forged, and then welded or braized together. For example, commercially available metal rods and sockets may simply be welded together in the correct orientation to provide the skateboard tool of the present invention.

In certain embodiments, the skateboard tool may, optionally, further comprise (preferably, in the double-headed socket) means for removing a bottle cap (i.e., a bottle opener). In one embodiment, the bottle cap removing means defines a diagonal notch in the double-headed socket head, which can be made by standard machining techniques.

The sockets are preferably variously-sized to accommodate nuts and bolts of different sizes, especially those commonly used on skateboards. Typically, the "standard" socket sizes needed for adjusting the truck, securing the truck to the board and for securing the wheels onto the ends of the axles are 9/16", 3/8" and 1/2" (all hexagonal), respectively. Therefore, the first socket 19 is preferably hexagonal and approximately 3/8", so as to be useful as a truck fastener socket. In a preferred embodiment, the first, second and third sockets (19, 21 and 23, respectively) have different sizes. In one embodiment, the three sockets are hexagonal and the size of the first socket 19 is approximately 3/8" and the sizes of the second socket 21 and the third socket 23 are, in either order, approximately 1/2" and approximately 9/16".

The specific socket sizes provided above are, of course, merely preferred sizes provided for example. Other appropriate socket sizes may be used within the scope of the present invention. The skilled artisan will be able to determine which socket sizes are desired by skateboard users depending on the most common nut and bolt sizes used on commercially available skateboards. The socket sizes may be standardized to either English or Metric dimensions, as appropriate. Also, while the preferred embodiment illustrated in the drawings includes hexagonal sockets, other socket shapes, patterns and configurations (including, for example, star patterns) can be used in accordance with the present invention.

The design of the present invention provides certain other advantages over prior art designs. The fact that the rod 12 extends outward diagonally when the first socket 19 is fitted over a truck fastener permits greater leverage for torquing than can be achieved where the socket is in-line with the rod, as in many prior art designs. In addition, the skateboard tool 10 of the present invention can be conveniently carried with the skater while he/she skateboards, since the tool is compact and generally flat. This allows the skater the freedom to do repairs on the spot, as well as to adjust the truck assembly and to change wheels or wheel bearings at any desired time.

Although the present invention has thus been described in detail with regard to certain preferred embodiments, it should be apparent to those skilled in the art that various adaptations and modifications of the present invention may be accomplished without departing from the spirit and the scope of the invention. Accordingly, the present invention is not limited to the specific embodiments illustrated herein. Those skilled in the art will understand that the detailed description as set forth hereinabove is not intended to limit the breadth of the present invention, which is instead defined by the appended claims and their appropriately construed legal equivalents.

All references, including U.S. patents, cited herein are incorporated by reference in their entirety.

What is claimed is:

1. A multi-socket hand tool structured for use with a skateboard, the tool comprising:

a rod having a first rod end, a second rod end, and a longitudinal axis;

a first socket head mounted to the first rod end, the first socket head defining a first socket, wherein the angle between a longitudinal axis of the first socket and the longitudinal axis of the rod is between about 95° and about 135°;

a second socket head and a third socket head mounted to the second rod end, the second socket head and the third socket head defining a second socket and a third socket, respectively, the second and third sockets defining a double-headed socket head, with longitudinal axes of the second and third sockets being co-linear, wherein the longitudinal axes of the first, second, and third sockets are co-planar; and an indentation in the double-headed socket head that provides means for removing a bottle cap.

2. The skateboard tool of claim 1, wherein the angle is between about 95° and about 110°.

3. The skateboard tool of claim 1, wherein the angle is between about 100° and about 105°.

4. The skateboard tool of claim 1, wherein the first socket is adapted for use as a truck fastener socket.

5. The skateboard tool of claim 1, wherein the length of the rod is between about 0.5" and about 6".

6. The skateboard tool of claim 1, wherein the length of the rod is between about 1" and about 3".

7. The skateboard tool of claim 1, wherein the second socket and the third socket are generally oppositely-directed.

8. The skateboard tool of claim 1, wherein the rod is generally linear.

9. The skateboard tool of claim 8, wherein the rod is generally cylindrical.

10. A socket tool, comprising:

a cylinder having a first cylinder end and a second cylinder end;

a first socket head at the first end;

a second socket head at the second end;

a center portion of the cylinder, between the second socket head and the third socket head, containing an indentation providing means for removing a bottle cap.

11. The socket tool of claim 10, further comprising a rod having a first rod end and a second rod end, the first rod end affixed to the cylinder opposite the indentation.

12. The socket tool of claim 11, further comprising a third socket head affixed to the second rod end at an angle between about 95° and about 135° relative to the longitudinal axis of the rod.

13. The skateboard tool of claim 1, wherein the first socket is hexagonal.

14. The skateboard tool of claim 13, wherein the size of the first pocket is approximately ⅜".

15. The skateboard tool of claim 1, wherein the first, second and third sockets have different sizes.

16. The skateboard tool of claim 15, wherein the first, second and third sockets are hexagonal.

17. The skateboard tool of claim 16, wherein the size of the first socket is approximately ⅜" and the sizes of the second and third sockets are, in either order, approximately ½" and approximately 9/16".

18. The skateboard tool of claim 1, wherein the tool comprises a metal, a metal matrix composite or a metal alloy.

19. The skateboard tool of claim 18, wherein the tool comprises a steel or steel alloy.

20. The skateboard tool of claim 17, wherein the tool is integral.

21. The skateboard tool of claim 20, wherein the tool is cast metal or metal alloy.

22. The skateboard tool of claim 18, wherein at least one of the first, second or third socket heads is mounted to the rod by welding or braizing.

* * * * *